US010689870B2

(12) United States Patent
Wu et al.

(10) Patent No.: US 10,689,870 B2
(45) Date of Patent: Jun. 23, 2020

(54) AUTOMATIC TENSIONING SYSTEM AND METHOD FOR STRENGTHENING BEAM, SLAB AND COLUMN BY PRE-STRESSED FRP PLATE

(71) Applicant: SOUTHEAST UNIVERSITY, Nanjing (CN)

(72) Inventors: Gang Wu, Nanjing (CN); Xinghua Li, Nanjing (CN)

(73) Assignee: SOUTHEAST UNIVERSITY, Nanjing (CN)

( * ) Notice: Subject to any disclaimer, the term of this patent is extended or adjusted under 35 U.S.C. 154(b) by 0 days.

(21) Appl. No.: 16/078,599

(22) PCT Filed: Mar. 30, 2017

(86) PCT No.: PCT/CN2017/078702
§ 371 (c)(1),
(2) Date: Aug. 21, 2018

(87) PCT Pub. No.: WO2017/197987
PCT Pub. Date: Nov. 23, 2017

(65) Prior Publication Data

US 2019/0048602 A1 Feb. 14, 2019

(30) Foreign Application Priority Data

May 20, 2016 (CN) ..... 2016 1 0341179

(51) Int. Cl.
*E04G 23/02* (2006.01)
*E04G 21/12* (2006.01)
(Continued)

(52) U.S. Cl.
CPC ..... *E04G 23/0244* (2013.01); *E01D 22/00* (2013.01); *E04C 5/12* (2013.01);
(Continued)

(58) Field of Classification Search
CPC ... E04G 23/0218; E04G 21/121; E04G 21/12; E04G 2023/0251; E04G 2023/0255;
(Continued)

(56) References Cited

U.S. PATENT DOCUMENTS 6,385,940 B1 * 5/2002 Maier ..... E04G 23/0218 52/223.1
6,584,738 B1 * 7/2003 Andra ..... E04G 21/121 52/223.13
(Continued)

FOREIGN PATENT DOCUMENTS

CN 204435929 U * 7/2015
EP 1033455 A1 * 9/2000 ..... E04G 23/0218
(Continued)

OTHER PUBLICATIONS

Derwent Abstract for Korean Patent Publication KR 2006104253 A by Ahn et al. (Year: 2006).*
(Continued)

*Primary Examiner* — Joshua J Michener
*Assistant Examiner* — Charissa Ahmad
(74) *Attorney, Agent, or Firm* — CBM Patent Consulting, LLC

(57) ABSTRACT

An automatic tensioning system for strengthening a beam, a slab and a column by a pre-stressed FRP plate comprises a tensioning end anchor (1), a fixed end anchor (10), and a tensioning bracket (3) connected to the tensioning end anchor (1). A centre-hole jack (16) is provided in the middle of the tensioning bracket (3), a threaded rod (8) passes through the tensioning bracket (3) and is then connected to the centre-hole jack (16), and an upper toothed nut (13) and a lower toothed nut (19) respectively driven by a driving mechanism are provided on two sides of the tensioning bracket (3) on the threaded rod (8). A binary clip-type fixture
(Continued)

(4) is further comprised, an upper surface thereof is provided with a cylinder (6), and a sleeve (7) nested outside the cylinder (6) is connected to the threaded rod (8).

8 Claims, 4 Drawing Sheets

(51) Int. Cl.
*E04C 5/12* (2006.01)
*E01D 22/00* (2006.01)

(52) U.S. Cl.
CPC ..... *E04G 21/12* (2013.01); *E04G 23/0237* (2013.01); *E04G 2023/0251* (2013.01); *E04G 2023/0255* (2013.01); *E04G 2023/0259* (2013.01)

(58) Field of Classification Search
CPC ..... E04G 2023/0259; E04G 2023/0262; E04C 5/127; E04C 5/085
See application file for complete search history.

(56) References Cited

U.S. PATENT DOCUMENTS 7,658,041 B2 * 2/2010 Andra ..... E04G 23/0218 52/223.13
9,068,365 B2 * 6/2015 Berset ..... E04G 23/0218
2005/0247016 A1 * 11/2005 Andra ..... E04C 5/127 52/745.21
2005/0252116 A1 * 11/2005 Maier ..... E04C 5/085 52/223.1
2014/0360129 A1 * 12/2014 Berset ..... E04G 23/0218 52/745.19
2017/0241202 A1 * 8/2017 Liu ..... B66F 11/04

FOREIGN PATENT DOCUMENTS

JP 02266050 A * 10/1990
JP 02266065 A * 10/1990
JP 09013672 A * 1/1997
JP 2002070323 A * 3/2002
WO WO 0216710 A2 * 2/2002
WO WO 2011092726 A1 * 8/2011

OTHER PUBLICATIONS

Machine Translation of Chinese Patent Publication CN 204435929 U (obtained from the European Patent Office at https://worldwide.espacenet.com, last accessed on Jan. 31, 2020) (Year: 2015).*

* cited by examiner

AUTOMATIC TENSIONING SYSTEM AND METHOD FOR STRENGTHENING BEAM, SLAB AND COLUMN BY PRE-STRESSED FRP PLATE

TECHNICAL FIELD

The present invention relates to the field of civil engineering traffic technologies, and more particularly, to an automatic tensioning system and method for strengthening a beam, a slab and a column by a pre-stressed FRP plate.

BACKGROUND

Due to the effects of material aging, construction quality, and other natural or man-made factors, many existing bridge engineering and houses are urgently needed to be repaired and strengthened, and all countries of the world will spend money lavishly on this every year. FRP plates have the advantages of light weight, high intensity and corrosion resistance. Pasting the FRP plate on the surface of a component for tension can increase and improve the performance of the component. An effective method to solve the problems above is to use the FRP plate with large elasticity modulus and apply a prestressing force on the FRP plate. By applying the prestressing force on the FRP plate and anchoring the FRP plate on the two ends of a concrete component through a special anchor, the strength utilization of the FRP plate can be increased, the performance of the strengthened structure can be better improved, cracks are effectively controlled, and the deflection of the component of the structure is reduced. It has very important meaning and function to introduce the prestressing force technology into the strengthening technology using FRP plate. However, for the existing tensioning system for strengthening a beam, a slab and a column by a pre-stressed FRP plate, since an anchor is separated from the fixing device, the tensioning system is too heavy and the force transmission is indirect, so that the strengthening is inconvenient, and the material is wasted; moreover, for the strengthening of a long-span bridge structure using FRP plate, since the stroke of a hydraulic jack is limited and cannot reach the requirement of a larger elongation value of the FRP plate, the jack needs to be jacked and released repeatedly, which is accompanied with a lot of manual operation, and wastes the time and energy.

SUMMARY

Object of the invention: in order to overcome the defects in the prior art, the present invention provides an automatic tensioning system and method for strengthening a beam, a slab and a column by a pre-stressed FRP plate.

Technical solution: in order to solve the technical problem above, an automatic tensioning system for strengthening a beam, a slab and a column by a pre-stressed FRP plate according to the present invention comprises a tensioning end anchor, a fixed end anchor, and a tensioning bracket connected to the tensioning end anchor; wherein a centre-hole jack is provided in the middle of the tensioning bracket, a threaded rod passes through the tensioning bracket and is then connected to the centre-hole jack, an upper toothed nut and a lower toothed nut respectively driven by a driving mechanism are provided on two sides of the tensioning bracket on the threaded rod; a binary clip-type fixture is further comprised, the upper surface of the binary clip-type fixture is provided with a cylinder, and a sleeve nested outside the cylinder is connected to the threaded rod; one end of an FRP plate is clamped into the clip-type fixture, and the other end of the FRP plate is anchored to the fixed end anchor.

The tensioning end anchor is composed of an anchor cup and two clamping pieces, the anchor cup is provided with two sets of threaded holes, one set of the holes are used for planting bars to a beam, and the other set of the holes are used for connecting the tensioning end anchor and the tensioning bracket by a screw rod.

A left motor and a right motor are respectively installed at the two sides of the centre-hole jack, the left motor drives the lower toothed nut through a left gear arranged on a motor shaft, and the right motor drives the upper toothed nut through a right gear arranged on the motor shaft.

The binary clip-type fixture is composed of an anchor cup and two clamping pieces separated from top to bottom, and the upper and lower anchor cups are connected through high-strength bolts.

The diameter of the sleeve is larger than the diameter of the cylinder, the height of the sleeve is the same as that of the cylinder, and the sleeve can rotate under the restriction of the cylinder and a column cap.

The FRP plate is one of a carbon FRP plate, a basalt FRP plate, a glass FRP plate and an aramid FRP plate, or the carbon FRP, the basalt FRP, the glass FRP, the aramid FRP and steel fiber composite plate.

The fixed end anchor is composed of an anchor cup and two clamping pieces, and the anchor cup is provided with a set of threaded holes, and is anchored on the beam through planting bars.

The plane of the centre-hole jack relative to the lower toothed nut is provided with a lower contact sensor, and the plane of the tensioning bracket relative to the upper toothed nut is provided with an upper contact sensor.

A method for strengthening a beam, a slab and a column by a pre-stressed FRP plate comprises the following steps of:

(1) planting bars on a beam or a slab, and fixing a tensioning end anchor and a fixed end anchor;

(2) passing an FRP plate through an anchor cup of the tensioning end anchor, and respectively anchoring the two ends of the FRP plate on a binary clip-type fixture and the fixed end anchor through a clamping piece;

(3) anchoring the tensioning bracket on the tensioning end anchor through high-strength bolts;

(4) passing a threaded rod through a toothed nut and a centre-hole jack and connecting the threaded rod to a cylinder, and rotating the toothed nut to fit to the front surface of the centre-hole jack and a front baffle of a tensioning bracket;

(5) jacking the jack, driving the threaded rod to move upwardly through a lower toothed nut, applying a prestressing force on the FRP plate, and driving the upper toothed nut to move upwardly so as to be out of contact with the tensioning bracket meanwhile;

(6) controlling the work of a right motor after the centre-hole jack reaches to the maximum stroke, driving the upper toothed nut to rotate downwardly to fit to the front baffle of the tensioning bracket, through a right gear and stopping the work of the right motor after an upper contact sensor alarms;

(7) conducting an oil discharge operation to the centre-hole jack, wherein the tensioning force of the FRP plate at the moment is transmitted to the tensioning bracket through the threaded rod and the upper toothed nut;

(8) controlling the work of a left motor, driving the lower toothed nut to rotate downwardly to fit to the front surface of the centre-hole jack through a left gear, and stopping the work of the left motor after a lower contact sensor alarms;

(9) repeating steps (5) to (8) until the tensioning force of the FRP plate reaches to a design value;

(10) wedging the clamping piece into the anchor cup of the tensioning end anchor to fix the FRP plate;

and (11) demounting the binary clip-type fixture to achieve the purpose of releasing the prestressing force, and removing the binary clip-type fixture and the tensioning bracket.

The FRP plate is one of a carbon FRP plate, a basalt FRP plate, a glass FRP plate and an aramid FRP plate, or the carbon FRP, the basalt FRP, the glass FRP, the aramid FRP and steel fiber composite plate.

Beneficial effects: the automatic tensioning system for strengthening a beam, a slab and a column by a pre-stressed FRP plate according to the present invention has the following beneficial effects.

1. Displacement control can be automatically conducted on the upper and lower toothed nuts through the controlling of the motor, so as to realize the maintenance and continuous tension to the prestressing force of the FRP plate in the process of jacking and releasing the jack.

2. The working status of the toothed nut can be determined in real time through the effect of the contact sensor, so as to guarantee the security in the process of jacking and releasing the jack.

3. It does not need a lot of processes of tightening the nut during construction, which saves a lot of labour cost, and can accelerate the whole construction process and shorten the construction period.

4. The present invention makes it possible to strengthen the long-span bridge with the FRP plates, and greatly reduces the requirement on the stroke of the jack.

DETAILED DESCRIPTION

Figure 1:
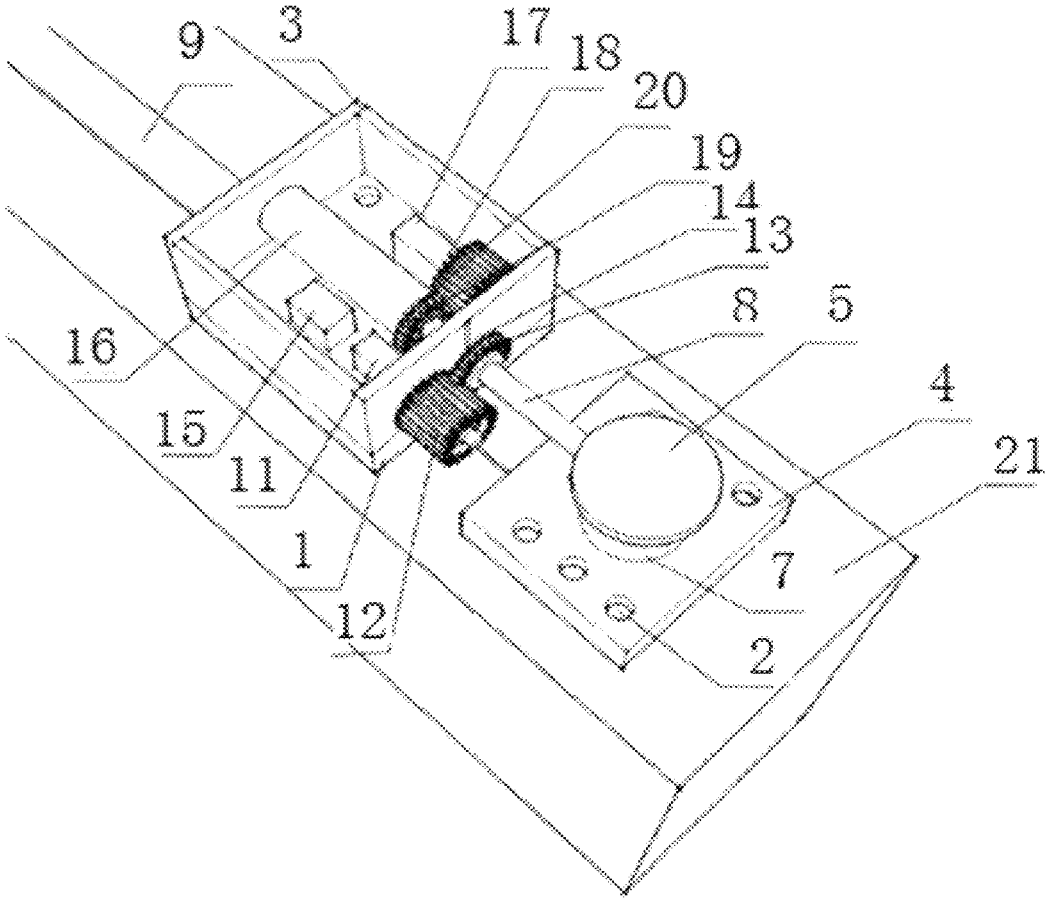
FIG. 1 is a schematic diagram of a stereochemical structure of the present invention.
Figure 2:
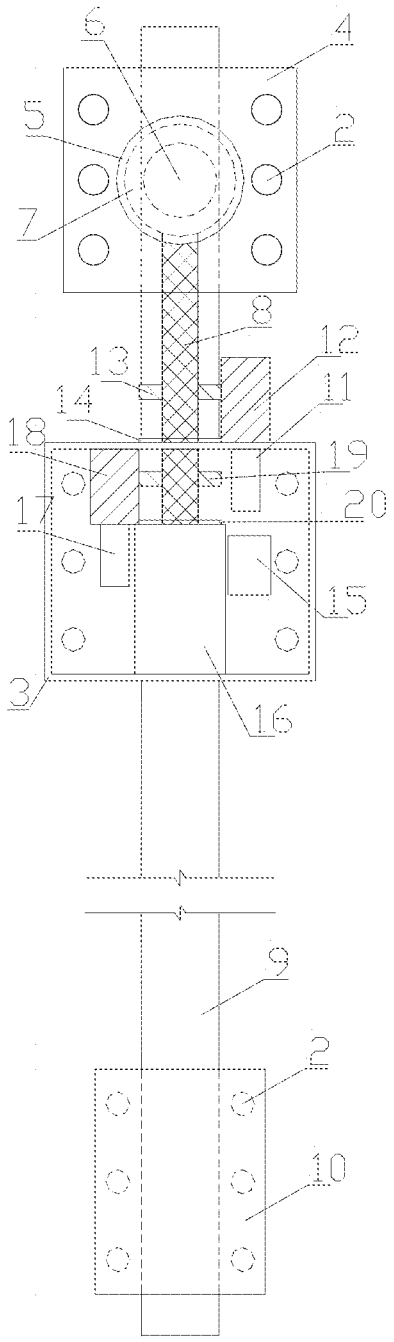
FIG. 2 is a top view of an automatic tensioning system for strengthening a beam, a slab and a column by a pre-stressed FRP plate according to the present invention.
Figure 3:
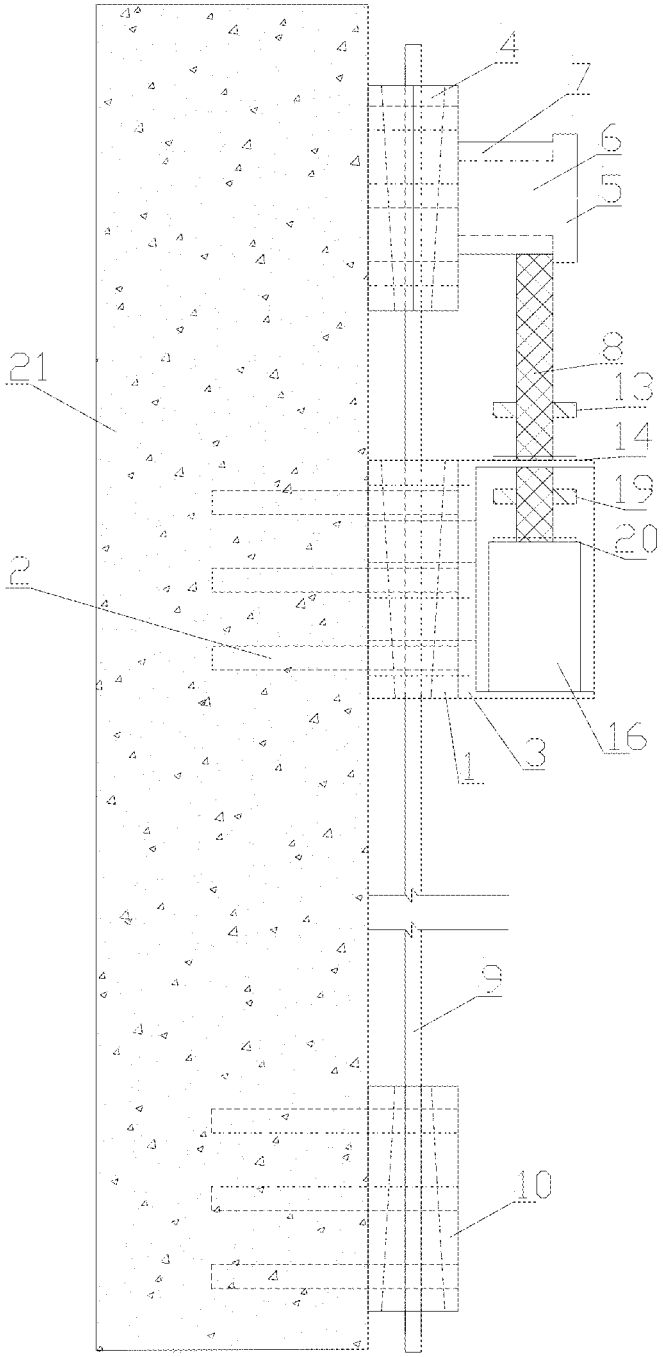
FIG. 3 is a front view of an automatic tensioning system for strengthening a beam, a slab and a column by a pre-stressed FRP plate according to the present invention.

As shown in FIG. 1 to FIG. 3, an automatic tensioning system for strengthening a beam, a slab and a column by a pre-stressed FRP plate according to the present invention comprises a tensioning end anchor 1, a fixed end anchor 10, and a tensioning bracket 3 connected to the tensioning end anchor 1; wherein a centre-hole jack 16 is provided in the middle of the tensioning bracket 3, a threaded rod 8 passes through the tensioning bracket 3 and is then connected to the centre-hole jack 16, an upper toothed nut 13 and a lower toothed nut 19 respectively driven by a driving mechanism are provided on two sides of the tensioning bracket 3 on the threaded rod 8; a binary clip-type fixture 4 is further comprised, the upper surface of the binary clip-type fixture 4 is fixedly provided with a cylinder 6, and a sleeve 7 nested outside the cylinder 6 is connected to the threaded rod 8; one end of an FRP plate 9 is clamped into the clip-type fixture 4, and the other end of the FRP plate 9 is anchored to the fixed end anchor 10. The tensioning end anchor 1 is composed of an anchor cup and two clamping pieces, the anchor cup is provided with two sets of threaded holes, one set of the holes are used for planting bars to anchor on a beam, and the other set of the holes are used for connecting the tensioning end anchor 1 and the tensioning bracket 3 by a screw rod. A left motor 17 and a right motor 11 are respectively installed at the two sides of the centre-hole jack 16, the left motor drives the lower toothed nut through a left gear arranged on a motor shaft, and the right motor drives the upper toothed nut 13 through a right gear 12 arranged on the motor shaft. The binary clip-type fixture 4 is composed of an anchor cup and two clamping pieces separated from top to bottom, and the upper and lower anchor cups are connected through high-strength bolts 2. The diameter of the sleeve 7 is larger than the diameter of the cylinder 6, the height of the sleeve 7 is the same as that of the cylinder 6, and the sleeve 7 can rotate under the restriction of the cylinder 6 and a column cap 5. The FRP plate 9 is one of a carbon FRP plate, a basalt FRP plate, a glass FRP plate and an aramid FRP plate, or the carbon FRP, the basalt FRP, the glass FRP, the aramid FRP and steel fiber composite plate. The fixed end anchor 10 is composed of an anchor cup and two clamping pieces, and the anchor cup is provided with a set of threaded holes, and is anchored on the beam through planting bars. The plane of the centre-hole jack 16 relative to the lower toothed nut 19 is provided with a lower contact sensor 20, and the plane of the tensioning bracket 3 relative to the upper toothed nut 13 is provided with an upper contact sensor 14.

The present invention further provides a method for strengthening a beam, a slab and a column by a pre-stressed FRP plate, which comprises the following steps of:

(1) planting bars on a beam or a slab, and fixing a tensioning end anchor 1 and a fixed end anchor 10;

(2) passing an FRP plate 9 through an anchor cup of the tensioning end anchor 1, and respectively anchoring the two ends of the FRP plate on a binary clip-type fixture 4 and the fixed end anchor 10 through a clamping piece;

(3) anchoring the tensioning bracket 3 on the tensioning end anchor 1 through high-strength bolts 2;

(4) passing a threaded rod 8 through an upper toothed nut 13 and a centre-hole jack 16 and connecting the threaded rod 8 to a cylinder 6, and rotating the toothed nut 13 to fit to the front surface of the centre-hole jack 16 and a front baffle of the tensioning bracket 3;

(5) jacking the jack, driving the threaded rod 8 to move upwardly through a lower toothed nut 19, applying a pre-stressing force on the FRP plate 9, and driving the upper toothed nut 13 to move upwardly so as to be out of contact with the tensioning bracket 3 meanwhile;

(6) controlling the work of a right motor 11 after the centre-hole jack 16 reaches to the maximum stroke, driving the upper toothed nut 13 to rotate downwardly to fit to the front baffle of the tensioning bracket 3 through a right gear 12, and stopping the work of the right motor 11 after the upper contact sensor 14 raises the alarm;

(7) conducting an oil discharge operation to the centre-hole jack 16, wherein the tensioning force of the FRP plate 9 at the moment is transmitted to the tensioning bracket 3 through the threaded rod 8 and the upper toothed nut 13;

(9) controlling the work of a left motor 17, driving the lower toothed nut 19 to rotate downwardly to fit to the front surface of the centre-hole jack 16 through a left gear 18, and stopping the work of the left motor 18 after a lower contact sensor 20 alarms;

(9) repeating steps (5) to (8) until the tensioning force of the FRP plate 9 reaches to a design value;

(10) wedging the clamping piece into the anchor cup of the tensioning end anchor 1 to fix the FRP plate 9;

and

(11) demounting the binary clip-type fixture 4 to achieve the purpose of releasing the prestressing force, and removing the binary clip-type fixture 4 and the tensioning bracket 3.

The FRP plate 9 is one of a carbon FRP plate, a basalt FRP plate, a glass FRP plate and an aramid FRP plate, or the carbon FRP, the basalt FRP, the glass FRP, the aramid FRP and steel fiber composite plate.

Figure 4:
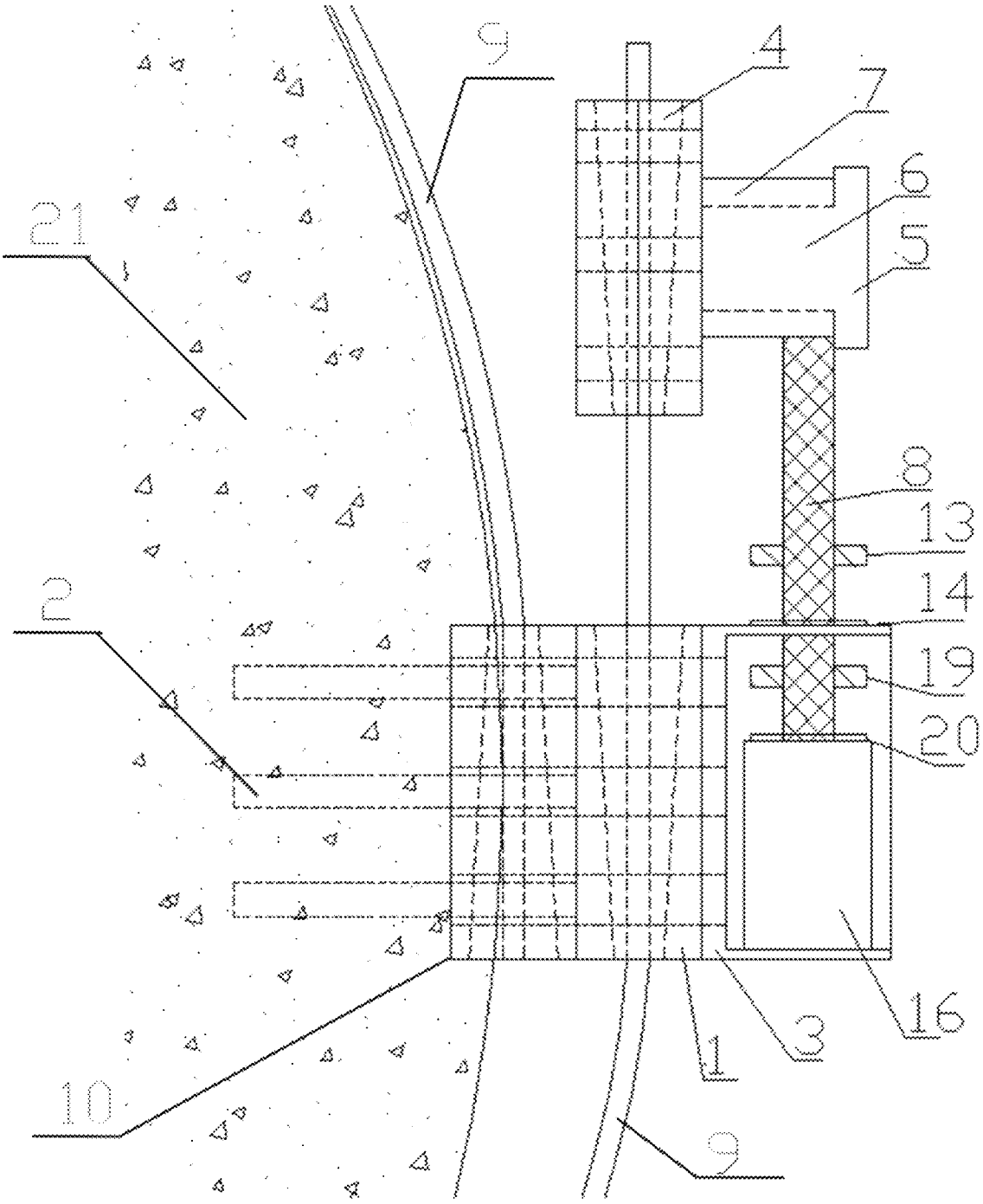
FIG. 4 is a front view of an automatic tensioning system for strengthening a beam, a slab and a column by a pre-stressed FRP plate according to the present invention for strengthening a column; in the figures: 1 refers to tensioning end anchor, 2 refers to high-strength bolt, 3 refers to tensioning bracket, 4 refers to binary clip-type fixture, 5 refers to column cap, 6 refers to cylinder, 7 refers to sleeve, 8 refers to threaded rod, 9 refers to FRP plate, 10 refers to fixed end anchor, 11 refers to right motor, 12 refers to right gear, 13 refers to upper toothed nut, 14 refers to upper contact sensor, 15 refers to power supply, 16 refers to centre-hole jack, 17 refers to left motor, 18 refers to left gear, 19 refers to lower toothed nut, 20 refers to lower contact sensor, and 21 refers to concrete beam or slab or column.

As shown in FIG. 4, the tensioning system is used for strengthening a strengthened concrete column, which comprises a tensioning end anchor 1, a fixed end anchor 10, and a tensioning bracket 3 connected to the tensioning end anchor 1; wherein a centre-hole jack 16 is provided in the middle of the tensioning bracket 3, a threaded rod 8 passes through the tensioning bracket 3 and is then connected to the centre-hole jack 16, an upper toothed nut 13 and a lower toothed nut 19 respectively driven by a driving mechanism are provided on two sides of the tensioning bracket 3 on the threaded rod 8; a binary clip-type fixture 4 is further comprised, the upper surface of the binary clip-type fixture 4 is fixedly provided with a cylinder 6, and a sleeve 7 nested outside the cylinder 6 is connected to the threaded rod 8; one end of an FRP plate 9 is clamped into the clip-type fixture 4, and the other end of the FRP plate 9 is anchored to the fixed end anchor 10. The fixed end anchor 10 is composed of an anchor cup and two clamping pieces, and the anchor cup is provided with two sets of threaded holes, one set of holes are used for anchoring on the beam through planting bars, and the other set of the holes are used for connecting the tensioning end anchor 1 and the tensioning bracket 3 by a screw rod. A left motor 17 and a right motor 11 are respectively installed at the two sides of the centre-hole jack 16, the left motor drives the lower toothed nut through a left gear arranged on a motor shaft, and the right motor drives the upper toothed nut 13 through a right gear 12 arranged on the motor shaft. The binary clip-type fixture 4 is composed of an anchor cup and two clamping pieces separated from top to bottom, and the upper and lower anchor cups are connected through high-strength bolts 2. The diameter of the sleeve 7 is larger than the diameter of the cylinder 6, the height of the sleeve 7 is the same as that of the cylinder 6, and the sleeve 7 can rotate under the restriction of the cylinder 6 and a column cap 5. The FRP plate 9 is one of a carbon FRP plate, a basalt FRP plate, a glass FRP plate and an aramid FRP plate, or the carbon FRP, the basalt FRP, the glass FRP, the aramid FRP and steel fiber composite plate. The plane of the centre-hole jack 16 relative to the lower toothed nut 19 is provided with a lower contact sensor 20, and the plane of the tensioning bracket 3 relative to the upper toothed nut 13 is provided with an upper contact sensor 14.

The tensioning system is used for strengthening a strengthened concrete column, which comprises the following steps of:

(1) planting bars on the column, and installing the fixed end anchor 10;

(2) passing the FRP plate 9 through the anchor cup of the tensioning end anchor 1, and respectively anchoring the two ends of the FRP plate on the binary clip-type fixture 4 and the fixed end anchor 10 through the clamping piece;

(3) anchoring the tensioning bracket 3 and the tensioning end anchor 1 on the fixed end anchor 10 through the high-strength bolts 2;

(4) passing the threaded rod 8 through the upper toothed nut 13 and the centre-hole jack 16 and connecting the threaded rod 8 to the cylinder 6, and rotating the toothed nut 13 to fit to the front surface of the centre-hole jack 16 and the front baffle of the tensioning bracket 3;

(5) jacking the jack, driving the threaded rod 8 to move upwardly through the lower toothed nut 19, applying a prestressing force on the FRP plate 9, and driving the upper toothed nut 13 to move upwardly so as to be out of contact with the tensioning bracket 3 meanwhile;

(6) controlling the work of the right motor 11 after the centre-hole jack 16 reaches to the maximum stroke, driving the upper toothed nut 13 to rotate downwardly to fit to the front baffle of the tensioning bracket 3 through the right gear 12, and stopping the work of the right motor 11 after the upper contact sensor 14 alarms;

(7) conducting an oil discharge operation to the centre-hole jack 16, wherein the tensioning force of the FRP plate 9 at the moment is transmitted to the tensioning bracket 3 through the threaded rod 8 and the upper toothed nut 13;

(8) controlling the work of the left motor 17, driving the lower toothed nut 19 to rotate downwardly to fit to the front surface of the centre-hole jack 16 through the left gear 18, and stopping the work of the left motor 18 after a lower contact sensor 20 alarms;

(9) repeating steps (5) to (8) until the tensioning force of the FRP plate 9 reaches to a design value;

(10) wedging the clamping piece into the anchor cup of the tensioning end anchor 1 to fix the FRP plate 9; and

(11) demounting the binary clip-type fixture 4 to achieve the purpose of releasing the prestressing force, and removing the binary clip-type fixture 4 and the tensioning bracket 3.

The automatic tensioning system and method for strengthening a beam, a slab and a column by a pre-stressed FRP plate of the present invention can automatically conduct displacement control on the upper and lower toothed nuts through the controlling of the motor, so as to realize the maintenance and continuous tension to the prestressing force of the FRP plate in the process of jacking and unloading the jack. The working status of the toothed nut can be determined in real time through the effect of the contact sensor, so as to guarantee the security in the process of jacking and unloading the jack. It does not need a lot of processes of tightening the nut during construction, which saves a lot of labour cost, and can accelerate the whole construction process and shorten the construction period. The present invention makes it possible to strengthen the long-span bridge by the FRP plates, and greatly reduces the requirement on the stroke of the jack.

The contents above are only preferred embodiments of the invention. It shall be pointed out that those skilled in the art can make a plurality of improvements and polishing without departing from the principle of the invention, which shall also fall within the protection scope of the invention.

What is claimed is:

1. An automatic tensioning system for strengthening a beam, a slab and a column by a pre-stressed FRP plate, comprising a tensioning end anchor (1), a fixed end anchor (10), and a tensioning bracket (3) connected to the tensioning end anchor (1); wherein a centre-hole jack (16) is provided in the middle of the tensioning bracket (3), a threaded rod (8) passes through the tensioning bracket (3) and is then connected to the centre-hole jack (16), an upper toothed nut (13) and a lower toothed nut (19) respectively driven by a driving mechanism are provided on two sides of the tensioning bracket (3) on the threaded rod (8); further comprising a binary clip-type fixture (4), wherein the upper surface of the binary clip-type fixture (4) is provided with a cylinder (6), and a sleeve (7) nested outside the cylinder (6) is connected to the threaded rod (8); one end of an FRP plate (9) is clamped into the clip-type fixture (4), and the other end of the FRP plate (9) is anchored to the fixed end anchor (10).

2. The automatic tensioning system for strengthening a beam, a slab and a column by a pre-stressed FRP plate according to claim 1, wherein the tensioning end anchor (1) is composed of an anchor cup and two clamping pieces, the anchor cup is provided with two sets of threaded holes, one set of the holes are used for planting bars to anchor on the beam, and the other set of the holes are used for connecting the tensioning end anchor (1) and the tensioning bracket (3) by a screw rod.

3. The automatic tensioning system for strengthening a beam, a slab and a column by a pre-stressed FRP plate according to claim 1, wherein the driving mechanism further comprises a left motor (17) and a right motor (11), which are respectively installed at the two sides of the centre-hole jack (16), the left motor drives the lower toothed nut through a left gear arranged on a motor shaft, and the right motor drives the upper toothed nut (13) through a right gear (12) arranged on the motor shaft.

4. The automatic tensioning system for strengthening a beam, a slab and a column by a pre-stressed FRP plate according to claim 1, wherein the binary clip-type fixture (4) is composed of an anchor cup and two clamping pieces separated from top to bottom, and the upper and lower anchor cups are connected through high-strength bolts (2).

5. The automatic tensioning system for strengthening a beam, a slab and a column by a pre-stressed FRP plate according to claim 1, wherein a diameter of the sleeve (7) is larger than a diameter of the cylinder (6), the height of the sleeve (7) is the same as that of the cylinder (6), and the sleeve (7) can rotate under the restriction of the cylinder (6) and a column cap (5).

6. The automatic tensioning system for strengthening a beam, a slab and a column by a pre-stressed FRP plate according to claim 1, wherein the FRP plate (9) is one of a carbon FRP plate, a basalt FRP plate, a glass FRP plate and an aramid FRP plate.

7. The automatic tensioning system for strengthening a beam, a slab and a column by a pre-stressed FRP plate according to claim 1, wherein the fixed end anchor (10) is composed of an anchor cup and two clamping pieces, and the anchor cup is provided with a set of threaded holes, and is anchored on the beam through planting bars.

8. The automatic tensioning system for strengthening a beam, a slab and a column by a pre-stressed FRP plate according to claim 1, wherein a plane of the centre-hole jack (16) relative to the lower toothed nut (19) is provided with a lower contact sensor (20), and the plane of the tensioning bracket (3) relative to the upper toothed nut (13) is provided with an upper contact sensor (14).

* * * * *